United States Patent [19]

Forsling et al.

[11] 4,242,049

[45] Dec. 30, 1980

[54] FOLDABLE PROPELLER

[75] Inventors: Hans Forsling, Örebro; Anders Lindecrantz, Svarta, both of Sweden

[73] Assignee: Hasselfors Stainless AB, Svarta, Sweden

[21] Appl. No.: 10,142

[22] Filed: Feb. 6, 1979

[30] Foreign Application Priority Data

Feb. 6, 1978 [SE] Sweden ..... 7801345

[51] Int. Cl.[3] ..... B63H 1/24

[52] U.S. Cl. ..... 416/142; 416/166

[58] Field of Search ..... 416/142, 149, 166, 167

[56] References Cited

U.S. PATENT DOCUMENTS

| | | | |
|---|---|---|---|
| 731,020 | 6/1903 | Charles | 416/142 |
| 866,369 | 9/1907 | Learnard | 416/142 |
| 938,291 | 10/1909 | Thompson | 416/142 |
| 993,126 | 5/1911 | Thomspon | 416/142 |
| 2,481,751 | 9/1949 | James | 416/142 |
| 2,500,382 | 3/1950 | Rowley | 416/143 |
| 4,086,025 | 4/1978 | Astrand | 416/142 |
| 4,094,614 | 6/1978 | Munk et al. | 416/142 X |

FOREIGN PATENT DOCUMENTS

| | | | |
|---|---|---|---|
| 2349929 | 4/1974 | Fed. Rep. of Germany | 416/142 |
| 60488 | 12/1939 | Norway | 416/142 |
| 878852 | 10/1961 | United Kingdom | 416/142 |
| 1268577 | 3/1972 | United Kingdom | 416/142 |

*Primary Examiner*—Everette A. Powell, Jr.

*Attorney, Agent, or Firm*—Hill, Van Santen, Steadman, Chiara & Simpson

[57] ABSTRACT

A foldable boat propeller comprising a hub to which the propeller blades are pivotally connected and which has two mutually turnable portions, one of which is fixedly secured to the propeller shaft and has a cam surface whereas the other one carries the propeller blades, and an axially shiftable plunger member which is mechanically connected to the propeller blades and unfolds them to working position on relative turning of the hub portions and axial shifting of said plunger means in response thereto only when the propeller shaft is driven in the reverse propulsion direction. Said plunger means is released for blade unfolding by centrifugal and water thrust force when the propeller shaft is driven in the forward propulsion direction.

1 Claim, 2 Drawing Figures

FOLDABLE PROPELLER

BACKGROUND OF THE INVENTION

1. Field of the Invention

This invention relates to a foldable propeller and more particularly a boat propeller of the type comprising a propeller hub and propeller blades movable carried by the hub in such a manner that they may be folded from a working position in which they project radially outwards from the propeller hub to a rest position in which they are directed backwards in line with the propeller shaft.

2. Prior Art

Several versions of propellers of this type, which are generally used with auxiliary engines for sailing boats, are already known. In the simplest version, the propeller blades unfold under the influence of the centrifugal force, both when forward propulsion is applied, and when propulsion in the reverse direction is applied. In some cases the inner ends of the propeller blades are interconnected in such a way that the blades will move simultaneously.

It has also been suggested that the blades should be designed in such a way that they do not cover each other completely in folded position. With such a design, parts of the edges of the blades will "grip" the water at the moment of starting, so that the blades will unfold because of the pitch of the blades.

Furthermore, a propeller design has been suggested where the propeller hub comprises elements which can be mutually turned to a limited extent, one element being immovably attached to the propeller shaft while the other element carries the foldable propeller blades. An axially movable member is coupled to the blades and, when the hub elements are turned in relation to each other, this member is axially moved to unfold the blades. The idea is, thus, that the propeller blades will be forced to unfold both when forward propulsion is applied and when propulsion in the reverse direction is applied.

The constructions described above have in common that they function comparatively well during forward propulsion. Irrespective of whether the main unfolding influence is the centrifugal force or the circumstance that the blades are also shaped in such a way that they "grip" the water and unfold because of the pitch of the blades, or whether the control device described above is used to achieve the unfolding, reasonably reliable function is achieved only during forward propulsion. When propulsion in the reverse direction is applied, however, satisfactory and reliable function cannot be achieved, especially not if a quick and sudden change of propulsion direction is required while the boat is moving forward at any noticeable speed, since the propeller blades must then unfold, and must stay unfolded, against the thrust exerted by the water current.

SUMMARY OF THE INVENTION

In order to provide for an improved reliability with respect to the propeller blade unfolding at reverse propulsion the propeller hub according to the present invention is provided with means causing the propeller blades to unfold and to lock them in the unfolded working position only when propulsion in the reverse direction is applied to the propeller shaft whereas said means leave the propeller blades to unfold under the influence of the centrifugal force and because of the pitch of the blades when forward propulsion is applied to the propeller shaft.

For a fuller understanding of the invention, reference may be had to the following description of a preferred embodiment illustrated on the accompanying drawing.

ON THE DRAWING

AS SHOWN ON THE DRAWING

Figure 1:
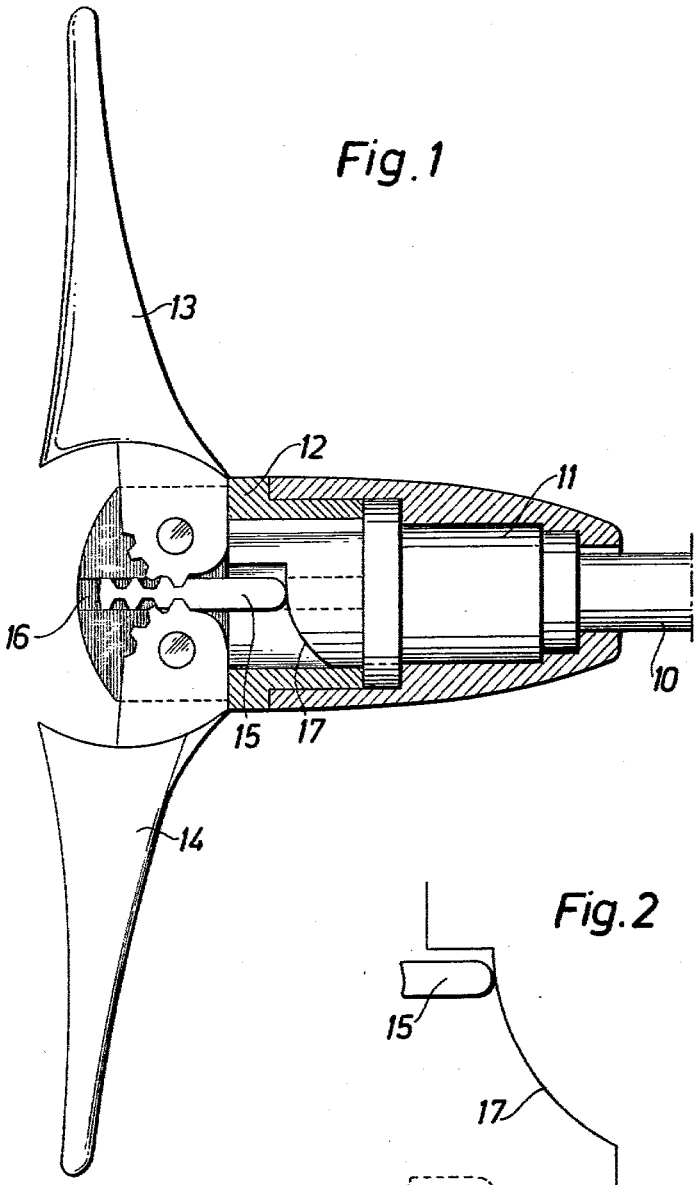
FIG. 1 is a side elevational view, partly in section, of a foldable propeller embodying the invention.
Figure 2:
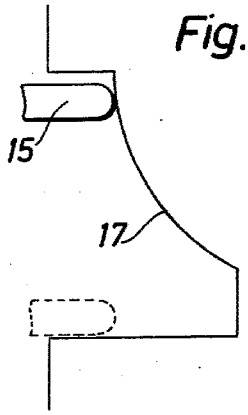
FIG. 2 is a diagrammatic view, on an enlarged scale, of a cam member and a cam follower.

The device includes a propeller shaft 10, to which is immovably attached a hub element, or a cam element 11. On the cam element 11, a second hub element carrier element 12 is rotatably mounted. This carrier element 12 carries a pair of propeller blades 13, 14 which are pivotably journalled within the carrier element 12. FIG. 1 shows the propeller in position for propulsion in the reversing direction, with the blades 13, 14 unfolded and locked in that position by means of a rack plunger 15. This plunger moves in a guide channel 16 and is pushed axially rearwards by a cam 17 when the cam element 11 and the carrier element 12 are turned in relation to each other. This mutual turning of the cam element 12 and the carrier element is brought about when the propeller shaft 11 starts to be driven in the direction needed for reverse propulsion of the boat, as the carrier element 12 at that moment stands still due to inertia. As best seen in FIG. 2, the cam 17 has an inclination which varies in the circumferential direction so that the inclination is zero or negative at the end of the cam path shown engaged by the plunger 15. When the cam 17 has turned in relation to the plunger 15, the rearward thrust of water of the blades 13, 14 will automatically shift the blades to their rest or streamlined position, whereupon there is a reduction of drag.

We claim as our invention:

1. A foldable propeller, comprising:

(a) a propeller shaft adapted to be drivingly rotated about its axis in one direction for forward propulsion, and in the opposite direction for reverse propulsion;

(b) a cam element co-rotatably secured to said shaft, and having a cam surface extending between abutments;

(c) a carrier element carried on said cam element, said elements being rotatable with respect to each other by a limited amount;

(d) a pair of propeller blades pivoted on said carrier element for movement between (1) a working position in which they project radially outwardly therefrom, and (2) a rest position in which they are directed rearwardly in line with said shaft, said blades being movable to said working position during rotating of said shaft in said one direction in response to centrifugal force and their pitch;

(e) a plunger means slidable axially in said carrier element and having a rack portion meshing with gear sectors on said propeller blades, and a cam follower portion for engaging said cam surface; and (f) said cam surface extending in a circumferential direction and having a degree of inclination varying in the axial direction from a relatively steep slope, where said cam follower portion is disengaged during shaft rotation in said one direction, to a zero or negative slope where said cam follower portion is engaged at the end of its travel during shaft rotation in said opposite direction.

* * * * *